United States Patent [19]

Lo

[11] 4,360,202

[45] Nov. 23, 1982

[54] CFRP OR FRP MADE BADMINTON RACKET FRAME

[76] Inventor: Kun-Nan Lo, No. 7-1, Lane 246, Section 3, Chung-Shan Rd., Tan Tzu Hsiang, Taichung Hsien, Taiwan

[21] Appl. No.: 152,400

[22] Filed: May 22, 1980

Related U.S. Application Data

[63] Continuation of Ser. No. 940,556, Sep. 8, 1978, abandoned.

[51] Int. Cl.[3] ..... A63B 49/10

[52] U.S. Cl. ..... 273/73 F; 273/73 G

[58] Field of Search ..... 273/67 R, 73 R, 73 C, 273/73 D, 73 F, 73 G, 73 H, 73 K, DIG. 7, DIG. 8, DIG. 23

[56] References Cited

U.S. PATENT DOCUMENTS

| | | | |
|---|---|---|---|
| 3,755,037 | 8/1973 | Erwin et al. | 273/73 F X |
| 3,771,805 | 11/1973 | Ishida | 273/73 F X |
| 3,949,988 | 4/1976 | Staufer | 273/73 F |
| 3,953,637 | 4/1976 | Phillips | 273/DIG. 23 |
| 4,070,021 | 1/1978 | Cecka | 273/73 F |
| 4,082,274 | 4/1978 | Stevens | 273/73 C |
| 4,119,313 | 10/1978 | Popplewell | 273/73 K |
| 4,128,963 | 12/1978 | Dano | 273/73 F X |
| 4,145,047 | 3/1979 | Nagamoto et al. | 73 F/ |

FOREIGN PATENT DOCUMENTS

| | | | |
|---|---|---|---|
| 2723628 | 12/1977 | Fed. Rep. of Germany | 273/73 F |
| 2033630 | 11/1970 | France | 273/73 F |
| 7359 | of 1901 | United Kingdom | 273/76 |
| 695064 | 8/1953 | United Kingdom | 273/73 F |
| 734214 | 7/1955 | United Kingdom | 273/73 R |
| 820197 | 9/1959 | United Kingdom | 273/73 R |
| 1209277 | 10/1970 | United Kingdom | 273/73 G |
| 1222819 | 2/1971 | United Kingdom | 273/73 H |
| 1223834 | 3/1971 | United Kingdom | 273/73 G |
| 1321235 | 6/1973 | United Kingdom | 273/73 H |
| 1423046 | 1/1976 | United Kingdom | 273/73 F |
| 1446306 | 8/1976 | United Kingdom | 273/73 G |

*Primary Examiner*—Richard J. Apley

[57] ABSTRACT

A badminton racket frame comprising a ring frame, a throat, a shaft and a grip wherein said parts of the racket frame further comprising a layer made of carbon fiber reinforced plastics or fiber reinforced plastics having been soaked in a high polymer epoxy resin to form a prepreg sheet, and a solid independent foaming material as the core thereof. The present badminton racket frame is hot-pressing molded and has a shaft with the foaming material core therein having a diameter around one millimeter.

1 Claim, 6 Drawing Figures

CFRP OR FRP MADE BADMINTON RACKET FRAME

This is a continuation of application Ser. No. 940,556, filed Sept. 8, 1978, now abandoned.

BACKGROUND OF THE INVENTION

The present invention relates to a badminton racket frame made of carbon fiber reinforced plastics or fiber reinforced plastics, especially to a badminton racket frame which is constructed seamless.

The known method for producing badminton racket frames comprises the processes of producing different parts such as a ring frame, throat, shaft and grip, and of constructing them into a whole racket. It is always difficult and complex to construct the above mentioned parts, especially the part between the ring frame and the throat. And the racket is easy to be broken at the throat when someone uses it to hit or smash a shuttlecock whereby causing accidents during the game.

The carbon fiber reinforced plastics (CFRP) or fiber reinforced plastics (FRP) has the advantages of high strength, good elasticity, high rigidity, good moisture-resistance, light weight, and good resistance to shock, damages, high temperature, and corrosion. Due to the above-mentioned advantages, the CFRP or FRP is used for manufacturing rackets of tennis, squash, badminton and the like.

The known racket frames, such as tennis racket frames, have been made of CFRP or FRP material to utilize the advantages of said materials especially for their good strength, elasticity, rigidity, moisture-resistance, creep-resistance and shock-attenuation.

A conventional method for producing racket frames adopts a mould which can form the frame, throat, shaft, and grip of the racket integrally by a single operation, a rubber tube filled with high-pressured gas is used there as the core of the mould. The CFRP or FRP prepreg material in the tube shape is placed in the mould and becomes hard by hot-pressing. The rubber tube is then pulled out from the mould and a kind of liquid foam plastic is poured into the core of the mould. Although this is a rather precise method, the compelex manufacture processes have caused this method to be discarded.

Another conventional method for producing the CFRP or FRP racket frames comprises a first process to insert the prepreg material in the mould and then a plastics film pipe filled with foaming material is arranged as the core of the mould. The whole racket frame can be hot-pressing moulded integrally by a single operation. This method is very popular in recent days. However, it still has some disadvantages. A plurality of plastics film layers are provided between the CFRP of FRP layer and the foaming material core, therefore the whole racket frame is not a single body. The foaming material core breaks from time to time by the force applied thereto whereby causing the center of gravity of the racket to deviate from its normal position and causing an unpleasant noise. Although this method is simple and the cost is low, the quality of the racket products is unfortunately decreased.

None of the conventional methods can produce a racket frame especially a badminton racket frame with a shaft having a diameter of about one millimeter.

SUMMARY OF THE INVENTION

The main object of the present invention is to provide a CFRP or FRP badminton racket frame which comprises a CFRP or FRP layer solidly and integrally constructed with the central foaming material.

A second object of the present invention is to provide a badminton racket frame which is hot-pressing moulded to make the CFRP or FRP material become hard and the foaming material to foam simultaneously under the same temperature.

Another object of the present invention is to provide a badminton racket frame with a shaft having a diameter of about one millimeter.

A further object of the present invention is to provide a badminton racket frame wherein the foaming material comprises thermo-plastics mixed with foaming agent and is used as an independent foaming material.

BRIEF DESCRIPTION OF THE DRAWINGS

These and other objects, features and advantages of the present invention will become apparent from the following detailed description of the preferred embodiment with reference to the accompanying drawings.

DETAILED DESCRIPTION OF THE PREFERRED EMBODIMENT

Figure 1:
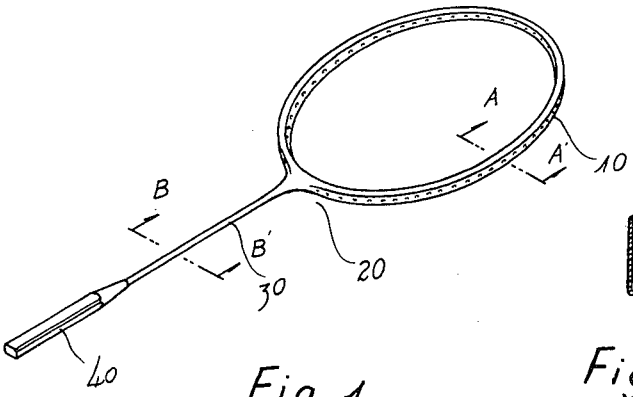
FIG. 1 is a perspective view of a badminton racket frame according to the present invention.
Figure 4:
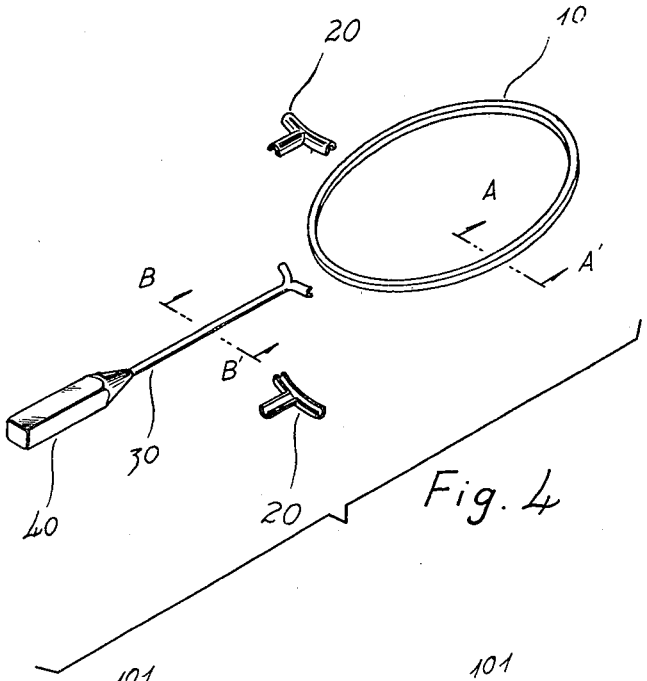
FIG. 4 is a perspective view of the embryo material of the racket frame according to the present invention.
Figure 5:
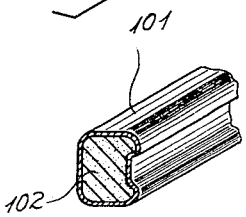
FIG. 5 is a sectional view of the ring frame part of the racket frame taken along a line A—A′ in FIG. 1.
Figure 6:
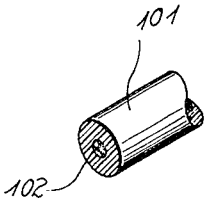
FIG. 6 is a sectional view of the shaft part of the racket frame taken along a line B—B′ in FIG. 1.

Referring to FIG. 1 which shows a perspective view of the badminton racket frame according to the present invention. FIGS. 5 and 6 show the internal structure of the racket frame. The racket frame comprises a closed ring frame 10, a throat 20 which is reinforced by CFRP or FRP prepreg material as shown in FIG. 4, a shaft 30 with a forked end cooperating with said ring frame 10 and the shaft 20, and a grip 40. The internal construction of the racket frame comprises a CFRP or FRP layer 101 and a solid independent foaming material core 102. The whole racket frame product is seamless, FIG. 1 showing the ring frame 10, the throat part 20, and the shaft 30, all connected seamlessly.

The CFRP or FRP layer 101 is made of prepreg sheet which is a product of CFRP or FRP material having been soaked in the high polymer epoxy resin. The prepreg sheet is turned into a hollow pipe shape with a solid independent foaming material inserted therein which is made of a thermo-plastics mixed with a foaming agent. Said foaming material is usually pressed into a stripe.

Figure 2:
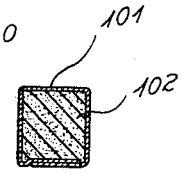
FIG. 2 is a sectional view of the embryo material of the racket frame corresponding to the ring frame part taken along a line A—A′ in FIG. 4.
Figure 3:
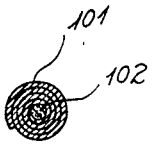
FIG. 3 is a sectional view of the embryo material of the racket frame corresponding to the shaft part taken along a line B—B′ in FIG. 4.

Referring to FIG. 4 which shows a perspective view of the embryo material of the racket frame of the present invention. FIGS. 2 and 3 show the sectional view of the ring frame part and the shaft part of the embryo material of the racket frame respectively. It is to be noted that the frame part is in a rectangular shape in cross section and the shaft part is in a circular shape in cross section. The embryo material of the racket frame is arranged in a mould for hot-pressing moulding, thereby making the CFRP or FRP prepreg sheet layer become hard and the foaming material foam and expand simultaneously under the same temperature.

The badminton racket frame according to the present invention has a close and tight construction of CFRP or FRP layer and the foaming material core, therefore contributing a high effect of elasticity, rigidity and shock-attenuation. In addition, the badminton racket frame of this invention may have a shaft with a diameter around one millimeter.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A badminton racket frame comprising:

a closed ring frame including a solid ring of foamed material and an outer jacket of fiber reinforced plastic, said outer jacket completely jacketing said ring;

a shaft having a diameter of approximately one millimeter, said shaft including a solid rod of foamed material and an outer jacket of fiber reinforced plastic;

a throat portion where said shaft is butted against and connected to the outer jacket of said ring frame in coplanar relationship and forms a seamless connection therewith; and a grip attached to said shaft;

whereby said racket frame has a fiber reinforced plastic outer layer and a solid independent foamed material as the core thereof, said layer and core being closely and tightly constructed to form a seamless racket frame.

* * * * *